US007398752B2

(12) United States Patent
Weaver

(10) Patent No.: US 7,398,752 B2
(45) Date of Patent: Jul. 15, 2008

(54) ROCKER ARM FOR VALVE ACTUATION

(76) Inventor: Robert R. Weaver, 109 Courtney La., Mooresville, NC (US) 28117-9254

( * ) Notice: Subject to any disclaimer, the term of this patent is extended or adjusted under 35 U.S.C. 154(b) by 136 days.

(21) Appl. No.: 11/302,181

(22) Filed: Dec. 12, 2005

(65) Prior Publication Data

US 2006/0124096 A1 Jun. 15, 2006

Related U.S. Application Data

(60) Provisional application No. 60/635,468, filed on Dec. 13, 2004.

(51) Int. Cl.
*F01L 1/18* (2006.01)

(52) U.S. Cl. ..... 123/90.39; 123/90.36; 123/90.41; 123/90.44; 384/28; 74/594; 74/579 R; 74/587; 74/559; 29/888.2; 29/898.041

(58) Field of Classification Search ..... 123/90.39; 384/28

See application file for complete search history.

(56) References Cited

U.S. PATENT DOCUMENTS

| | | | | | |
|---|---|---|---|---|---|
| 4,365,785 | A * | 12/1982 | Miller | ..... | 251/231 |
| 5,074,261 | A * | 12/1991 | Hamburg et al. | ..... | 123/90.39 |
| 5,970,933 | A * | 10/1999 | Ueda et al. | ..... | 123/90.39 |
| 6,267,090 | B1 * | 7/2001 | Schneider | ..... | 123/90.39 |
| 6,691,657 | B2 * | 2/2004 | Hendriksma et al. | ..... | 123/90.39 |
| 6,694,936 | B2 * | 2/2004 | Stallmann | ..... | 123/90.41 |
| 7,096,836 | B2 * | 8/2006 | Curtis | ..... | 123/90.43 |

* cited by examiner

*Primary Examiner*—Thomas Denion
*Assistant Examiner*—Kyle M Riddle
(74) *Attorney, Agent, or Firm*—Carter & Schnedler, PA.

(57) ABSTRACT

The present invention provides an improved rocker arm system for actuating poppet valves in high performance internal combustion engines. The rocker arm provides trunnion journals extending from each side fitted to outboard bearing mounts to guide the motion of the rocker arm. An I-beam rocker arm having high stiffness and low mass is disclosed.

1 Claim, 4 Drawing Sheets

ROCKER ARM FOR VALVE ACTUATION

CROSS-REFERENCE TO RELATED PATENT APPLICATIONS

This is a U.S. non-provisional application relating to and claiming the benefit of U.S. Provisional Patent Application Ser. No. 60/635,468, filed Dec. 13, 2004.

BACKGROUND OF THE INVENTION

1. Field of the Invention

The present invention relates to the field of internal combustion engines, high performance and conventional manufactured engines in general use, pertaining to poppet valve operating systems, particularly rocker arm systems for valve actuation pivoting on a shaft, the rocker arm being actuated by push rods and a camshaft.

2. Description of Background Information

Internal combustion engines, including high performance engines and conventionally manufactured engines, having poppet valve systems actuated by rocker arms and push rods that operate at high engine speeds or having high dynamic forces within the valve system require specially designed rocker arm systems for stability and for use in high inertia force conditions. For example, a high performance engine speed may peak at approximately 9200 revolutions per minute. This engine speed corresponds to a valve system actuating at 77 cycles per second. These high engine speeds cause very high inertia forces and high amplitude vibration forces to react on rocker arms and valve system components.

Rocker arms manufactured for performance engines generally have a common design basis. The common design consists of a rocker arm beam body having a needle bearing pressed in the beam body. The rocker arm pivots on a shaft that is rigidly fastened by 2 bolts through the shaft located one on each side of the beam to a mounting base attached to the engine cylinder head. Alternatively, the rocker arm beam body and needle bearing assembly are fitted to pivot on a pedestal or central stud mount.

Engines using push rods to actuate valves often have the push rod skewed in an oblique movement direction offset from the plane of rotation of the pivoting rocker arm, opening and closing the valve. This condition results because engine block and cylinder head castings are complicated with structure in the path areas where push rods operate. The resulting skewed push rod path applies a torque to the rocker arm beam that tends to deform the rocker arm beam and the supporting pivot bearing and pivot shaft mounting. FIG. 1. is a rear elevation view of a conventional high performance rocker arm system. Illustrated is the skewed offset push rod 17 and rocker arm 10 arrangements often found in performance engines. The offset push rod force (OPF) is illustrated by arrows at an angle to rocker arm pivot path 22. There are two improvement areas discussed in following paragraphs that the present invention addresses. First: Improvements for a stabilized rocker arm pivot system suitable for use in pushrod actuated systems. Second: Rocker arm beam improvements for reduction of mass and rotational inertia affects and improved beam stiffness.

The first improvement area: A stabilized rocker arm pivot requires different concepts to correct conventional rocker arm deficiencies. Many conventional rocker arms have skewed offset push rods and have a force vector at an angle reacting with the rocker arm. This condition results in rocker arm problems of torsional distortion and increased friction forces. These problems are primarily due to conventional rocker arm beams having a narrow bearing pressed into the beam, which does not provide sufficient resistive reaction to torsional loads. Instability at the rocker arm fulcrum also occurs because bearings commonly are over-stressed by the dynamic angled forces causing severe edge loading of the narrow bearing elements. The bearings then become excessively loose fitting and unstable to the mounting shaft causing unwanted valve train motion, vibration, valve spring surge and increased friction, all adding to performance loss. The torsional deformation of the rocker arm increases stress within the rocker arm body. Indeed, crack failures are common in the beam area near the push rod connection. These described conditions require precautionary and costly rocker arm replacement after a short service time in performance engines. Providing stable rocker arms is a needed improvement provided by the present invention.

The second improvement area: Reducing rocker arm beam mass is practiced by engineers in order to control inertia effects on the valve system. The purpose is to (1) achieve high engine speeds and aggressive valve actuation and lift rates to increase cylinder filling with air and fuel mixtures for applications requiring increased performance and (2) achieve improved engine efficiency by reducing friction and engine component inertia. A mechanism is required to provide stable, low mass rocker arms having high stiffness that can operate at increasingly high loads. Providing stable low mass rocker arms with reduced polar moment of inertia about the beam pivot axis is a significant factor to improve performance levels accomplished by the present invention.

SUMMARY OF THE INVENTION

In one form of the present invention there is provided a rocker arm system for internal combustion engines. A rocker arm is provided. A trunnion is attached to the rocker arm. Portions of the trunnion extend outwardly from each side of the rocker arm. First and second bearing mounts are provided for the trunnion. The bearing mounts are located on each side of the rocker arm. The bearing mounts receive and rotatably support the trunnion. A mounting base is provided. The bearing mounts are attached to the mounting base, which locate and restrain the bearing mounts.

In another form of the present invention there is provided a rocker arm mechanism for internal combustion engines wherein rocker arm components and geometry are dimensionally located on and from reference planes. A first reference plane is provided. Identified as the pivot plane and is collinear through the valve center longitudinal axis. Thus establishing a reference plane to locate and establish rocker arm rotational pivot motion and geometry in relation to the valve center axis. A second reference plane is provided and is normal to valve center longitudinal axis and normal to the first reference pivot plane and indicates the rocker arm pivot axis. The normal plane and pivot plane are applicable to establish component geometry, dimensions, mounting surfaces and locating the pivot axis from the valve tip end.

In another form of the present invention there is provided a rocker arm for internal combustion engines for valve actuation. A rocker arm body is provided. A trunnion pivot fulcrum and bearing assembly is fitted to the rocker arm beam body. The rocker arm body takes the general form of an I-beam member, or a solid beam form.

BRIEF DESCRIPTION OF THE DRAWIINGS

The drawings constitute a part of this specification and include the embodiment of this invention.

DETAILED DESCRIPTION OF THE PREFERRED EMBODIMENTS

In one specific embodiment of the present invention there is provided an improved rocker arm system for actuation of poppet valves in an internal combustion engine. The improved system embodies a rocker arm having trunnion journals, (cylindrical pivot projections, one each side), extending from each side of the rocker arm body, supported by outboard bearings and bearing mounts to guide the pivot motion of the rocker arm. The improved rocker arm embodiment with trunnion journals and outboard bearings embodies a widely spaced dual bearing support. This improvement provides stable resistance to rocker beam deforming torsional forces. The improved stability provides a rocker arm pivot system having accurate and precise valve actuation. Improving valve system stability and precision leads to higher potential engine speed and improved engine performance and reduced or eliminated unwanted valve train excitation, and reduced friction.

In another specific embodiment of the present invention there is provided a rocker arm made with trunnion journals and embodying an I-beam profile. This configuration increases torsional and bending stiffness, and decrease rotational inertia when compared to existing rocker arm systems.

Figure 1:
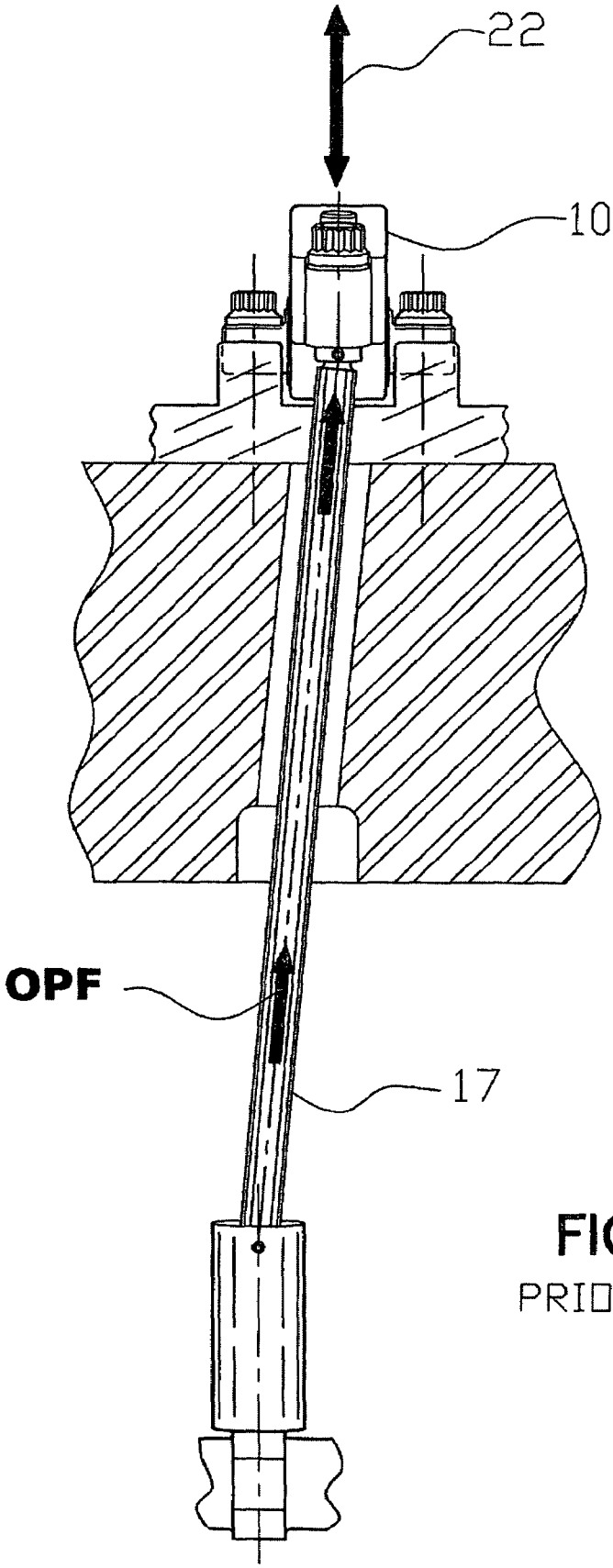
FIG. 1 PRIOR ART
FIG. 1 is a rear elevation view of a complete rocker arm system and components illustrating valve actuating systems manufactured for common use and illustrating skewed oblique push rod movement direction offset to rocker arm plane of rotation.
Figure 2:
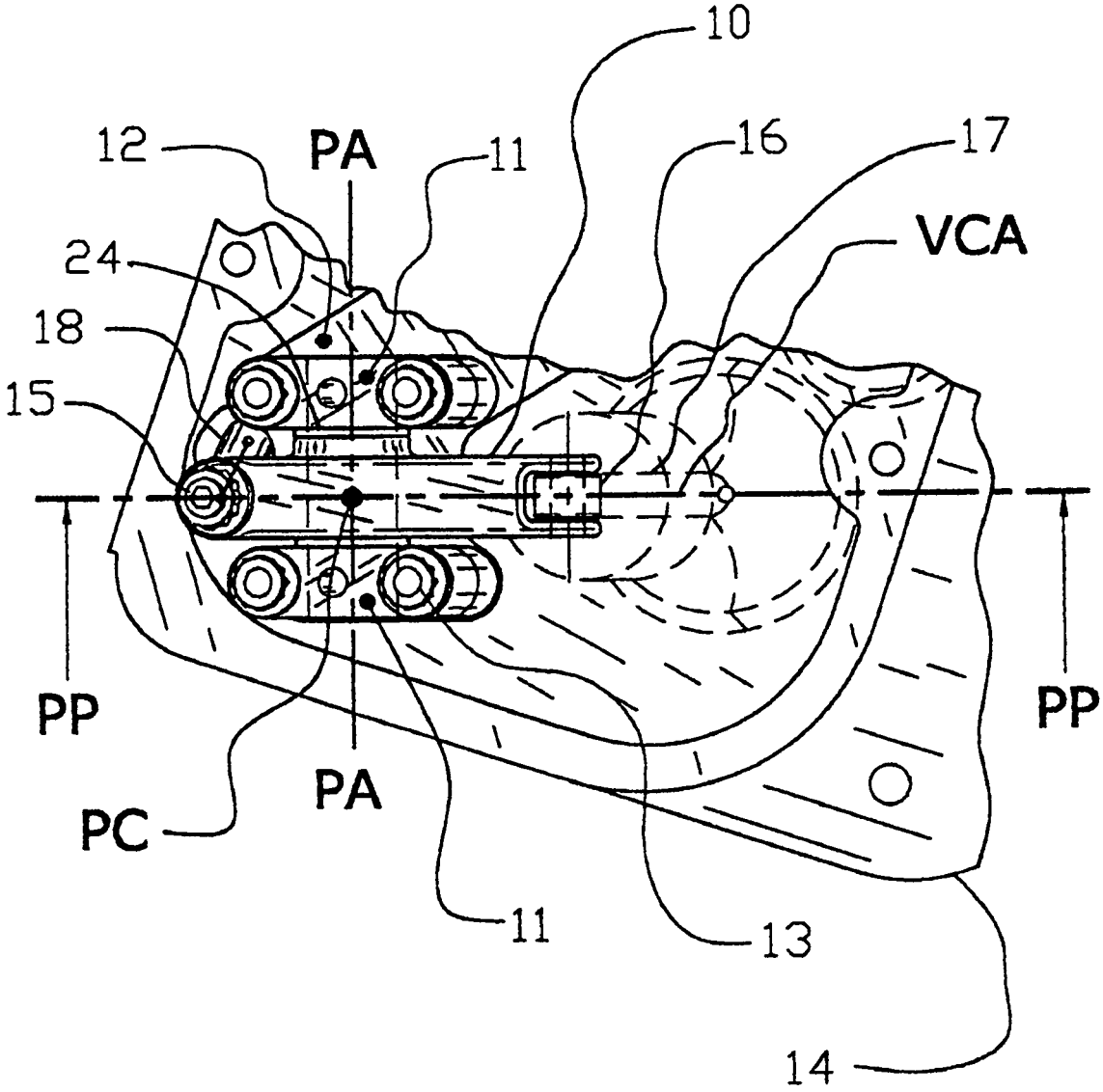
FIG. 2 is a plan view of the trunnion rocker arm assembly illustrating a system of one embodiment of the present invention.
Figure 3:
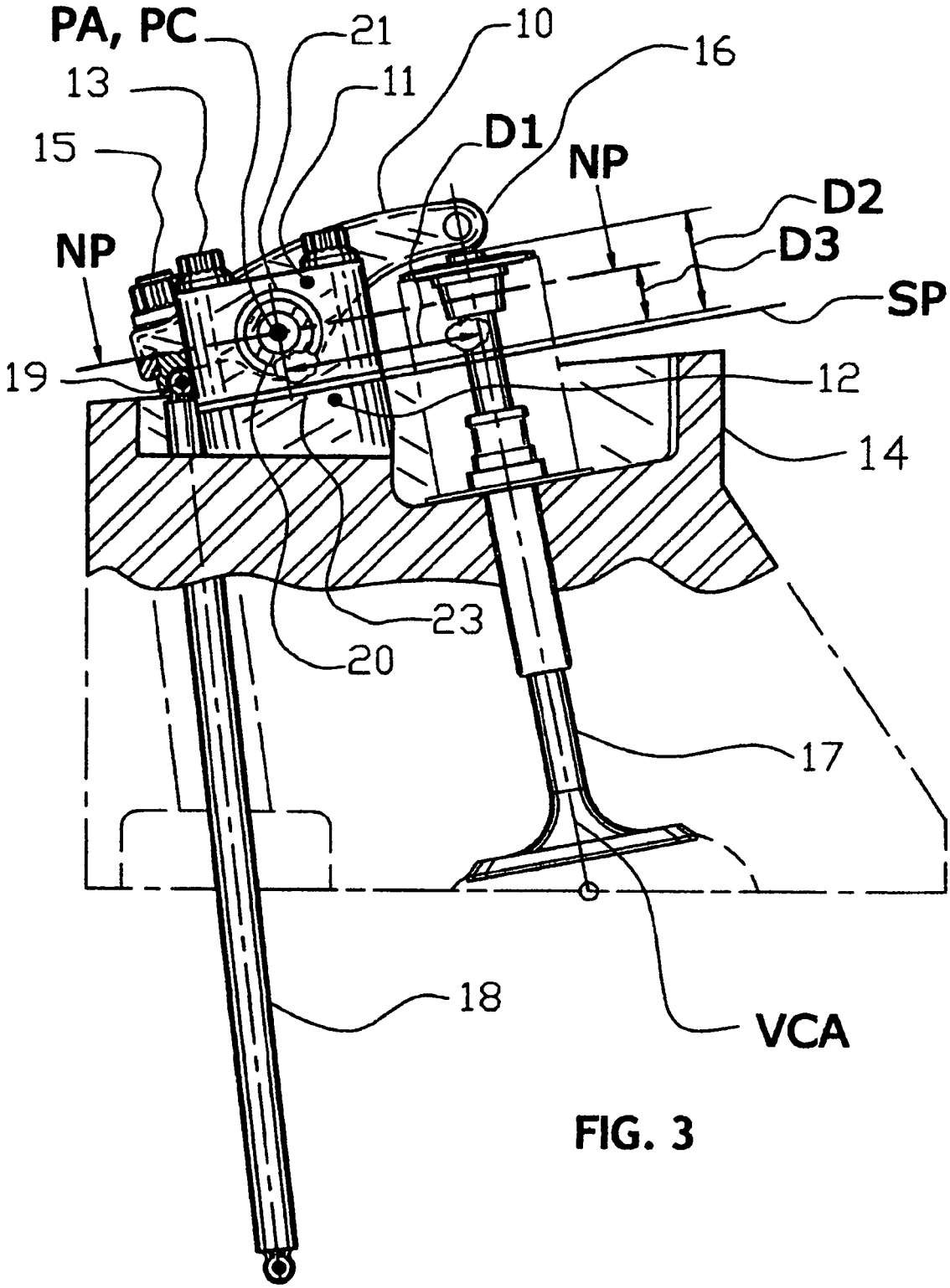
FIG. 3 is a side elevation view of the trunnion rocker arm assembly illustrating the embodiment of the FIG. 2 invention.

A detailed description beginning with reference to FIG. 2 and FIG. 3 of the drawings depicts a trunnion rocker arm 10 and system. Referring to FIG. 2 a plan view of the improved rocker arm system is illustrated incorporating a rocker arm 10 embodying trunnion journals (cylindrical projections) supported and pivoting within outboard bearing mounts 11 at each side. The bearing mounts 11 are fixed to mounting plate 12 being fastened with bolts 13 (or studs) 2 at each bearing mount 11 to provide a rigid mounting structure. Thrust bearing 24, located at each side of the rocker arm 10 between bearing mount 11 reduces friction and controls thrust between these components. Mounting plate 12 is in turn fastened to cylinder head 14 of an engine. Valve lash adjuster and lock nut assembly 15 is illustrated to provide adjustment of valve clearance between rocker arm roller 16 and valve 17 (shown in phantom). Valve clearance (lash) is required to accommodate and allow for engine thermal expansion. Valve lash adjustment is possible by other means; shim 23 is illustrated and discussed in reference to FIG. 3. A partial view is included in FIG. 2 illustrating a typical skewed oblique offset push rod 18 making connection 19 in FIG. 3 to rocker arm 10 at valve lash adjuster 15.

Referring to FIG. 3, a side elevation view illustrating a complete rocker arm system, depicting the trunnion rocker arm 10 and system of one embodiment of the present invention. Continuing with FIG. 3 general components not visible in FIG. 2 are shown. Rocker arm 10 has extended trunnion journals 20 each side of the rocker arm body that fit into outboard bearing mounts 11 at each side of rocker arm 10. The widely spaced bearing mounts increase system stability and load carrying capacity. Pivot bearing 21 illustrates a rolling element bearing, however pivot bearing 21 could be a monolithic low friction bearing element.

For certain applications reducing and sustaining a minimum pivot bearing radial clearance is desired for maximum precision. This is accomplished by eliminating the pivot bearing 21 and using specially prepared bearing mounts. The special bearing Mounts 11 and trunnion 20 consist of treated surfaces to the parent material, accomplished by applying selected surface materials, hardness and finish selections. Available material coating such as diamond like carbon (DLC) produced by plasma source ion implantation (PSII) is a preferred technology embodiment of the invention.

Geometric alignment of the rocker arm arc path and forces opening and closing the valve must align closely with the valve center axis (VCA). This is required to reduce valve stem deflection and friction that affect performance and reliability. Location of the rocker arm pivot, the pivot center (PC), defines rocker arm path geometry in relation to the valve opening and closing requirements and valve center axis VCA. The embodiment of reference planes provide a mechanism to establish precise rocker arm arc and pivot dimensional geometry and to dimensionally define component orientation with the engine cylinder head and for manufacturing, assembly and adjustments.

FIG. 2 and FIG. 3 disclose specification for reference planes and placement. Referring to FIG. 2, illustrated is the primary geometric reference plane, identified as reference pivot plane (PP). Being the preferred plane were rocker arm and motion geometry is defined. And, being the plane that orientates valve system component alignment to the cylinder head and valve. Reference plane PP is joined collinearly to the valve center axis VCA, establishing a first reference plane in alignment with the valve center axis. Directional alignment of reference plane PP provides a means to locate components and surfaces from the valve center axis VCA and reference plane PP within the engine cylinder head. Subsequent reference planes are generated relative to plane PP and a reference normal plane (NP). Referring to FIG. 3. Normal plane (NP) is specified as being normal to plane PP and normal to the valve center axis VCA. The rocker arm pivot center (PC) and pivot axis (PA) are defined as lying on plane NP. The locating position coincide on pivot plane PP as illustrated in FIG. 2 and FIG. 3. Referring to FIG. 3, Pivot axis PA is illustrated offset at distance D1 from the valve center axis VCA. Distance D1 is determined from rocker arm geometry. The linear dimension from the closed valve tip end position to plane NP and is also determined by rocker arm arc geometry that considers valve lift design requirements and is dimensioned from the bottom of bearing mounts 11 by D2 and D3.

Referring to FIG. 3, mounting plate 12 is manufactured having surface plane SP parallel to plane NP. The purpose is to (1) position components such as bearing mounts 11 and valve lash shim 23 in linear, direct line location, dimensioned from a manufactured surface plane SP. Purpose (2) insure that rocker arm pivot center PC and pivot axis PA remain in geometric alignment with the valve center axis VCA for assembly and adjustments. Surface plane SP is specified parallel to the normal plane NP. Dimension D2 locates bearing mount 11 base surface at a defined linear distance from the closed valve tip. Dimension D2 is complementary to establishing surface plane SP by including initial design shim thickness 23. Dimension D3 locates the pivot center PC and plane NP from the base of bearing mounts 11.

Figure 4:
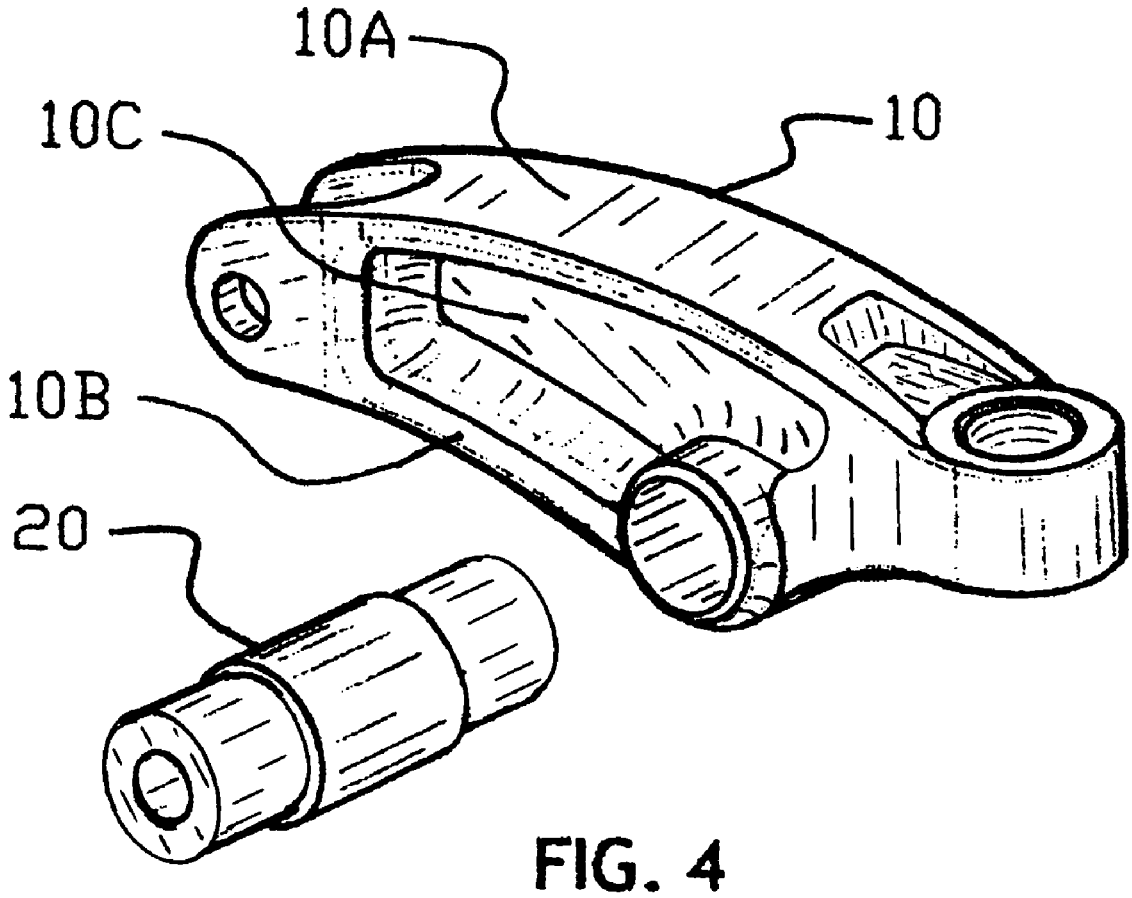
FIG. 4 is an isometric view of an I-beam rocker arm illustrating another embodiment of the present invention.

In another specific embodiment of the present invention the rocker arm beam 10 is specified configured having I-beam section form. This embodiment provides a means to manufacture by forging, machining or casting having the general form of an I-beam rocker arm. A general profile specified having an I-beam type form is illustrated in FIG. 4, identifying elements 10A, 10B and 10C of the I-beam embodiment. Beam element 10C, a vertical center web form may vary in shape and longitudinal thickness and placement, blending about the trunnion. Each element is profiled by varying thickness and blending to the trunnion and push rod end to shape the beam and provide maximum resistance to bending and torsional deformation at minimum mass. The trunnion shaft 20 is illustrated as separately manufactured and joined by a mechanical process, welding, and brazing, soldering or adhesive bonding. Separate trunnion shaft 20 is particularly suitable for bearing surface, hardness and finish processes such as diamond like carbon (DLC) surface applications. Alternatively, the rocker arm may be manufactured with trunnions integral to the beam body.

Although preferred embodiments have been specified in the detailed description, there are system variations and combinations of the disclosed embodiments not shown that may be used. Combinations using the trunnion mount, the I-beam or a solid beam rocker arm are applicable arrangement combinations. Reference planes and surface planes specified in the detailed description as a preferred embodiment are not a requirement for all applications. The specified detailed embodiments of the present invention are especially noted to be applicable to requirements of the general field of internal combustion engines.

What is claimed is:

1. A rocker arm system for internal combustion engines wherein rocker arm components and geometry are dimensionally located on and from reference axis and planes comprising:

a first reference axis being longitudinally concentric with the valve center;

a first reference plane collinear through the first reference axis, being the plane where rocker arm pivot geometry and pivot center is indicated;

a second reference plane being a normal plane to the first reference axis and the first reference plane, dimensionally located from the valve tip end;

a second reference axis being a rocker arm pivot axis and lying on the normal plane coincident with a rocker arm pivot center located on the first reference plane and consistent dimensionally from the valve tip end;

a third reference surface plane, a surface being parallel to the second reference normal plane, wherein rocker arm components, adjustment shims and mounting surfaces are dimensionally defined;

said third reference surface plane being applicable to establish defining positions and orientations for said components.

* * * * *